United States Patent [19]

Hopfe

[11] 3,976,351

[45] Aug. 24, 1976

[54] ELECTRICAL CONNECTOR

[75] Inventor: Dieter H. Hopfe, Houston, Tex.

[73] Assignee: Mark Products, Inc., Houston, Tex.

[22] Filed: Dec. 12, 1974

[21] Appl. No.: 531,896

[52] U.S. Cl. ..... 339/99 R; 339/274

[51] Int. Cl.[2] ..... H01R 9/08; H01R 11/20

[58] Field of Search ..... 339/98, 99 R, 75 R, 339/97 F, 274

[56] References Cited

UNITED STATES PATENTS

| | | | |
|---|---|---|---|
| 2,609,415 | 9/1952 | Benander et al. | 339/99 R |
| 2,627,537 | 2/1953 | Weisberg | 339/99 R |
| 3,474,389 | 10/1969 | Nagano | 339/274 X |

FOREIGN PATENTS OR APPLICATIONS

| | | | |
|---|---|---|---|
| 698,229 | 11/1940 | Germany | 339/274 |

*Primary Examiner*—Roy Lake
*Assistant Examiner*—E. F. Desmond
*Attorney, Agent, or Firm*—Jennings B. Thompson

[57] ABSTRACT

The connector disclosed includes a body having a groove in which an electrical cable can be positioned. Electrical contacts are positioned in the groove with each contact having a sharp end for penetrating the insulation of the cable and engaging the electrical conductors of the cable. A movable cable clamping member is pivotally attached to the body to move the cable against the contacts to cause the contacts to penetrate the cable insulation and make electrical contact with the conductors. A cam arm is pivotally mounted on the body to move the clamping member. The arm has a cam surface in engagement with the clamping member that forces the member to force the cable into electrical contact with the contacts carried by the base member. When the cam arm has so moved the movable member, it is in an "over-the-center" position, which locks the clamping member in position holding the cable against the contacts and in the groove on the body.

2 Claims, 4 Drawing Figures

FIG.1
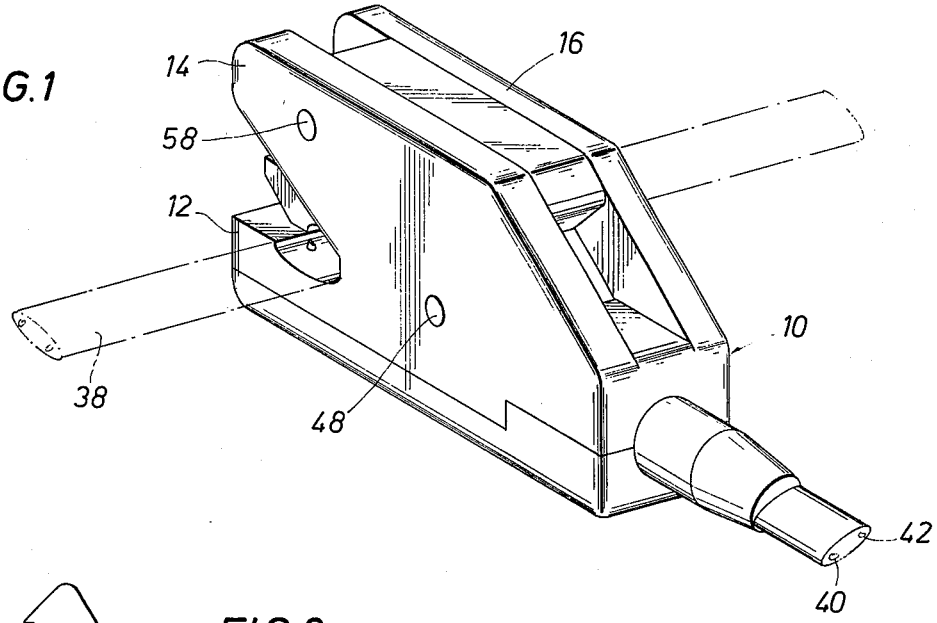
FIG.2
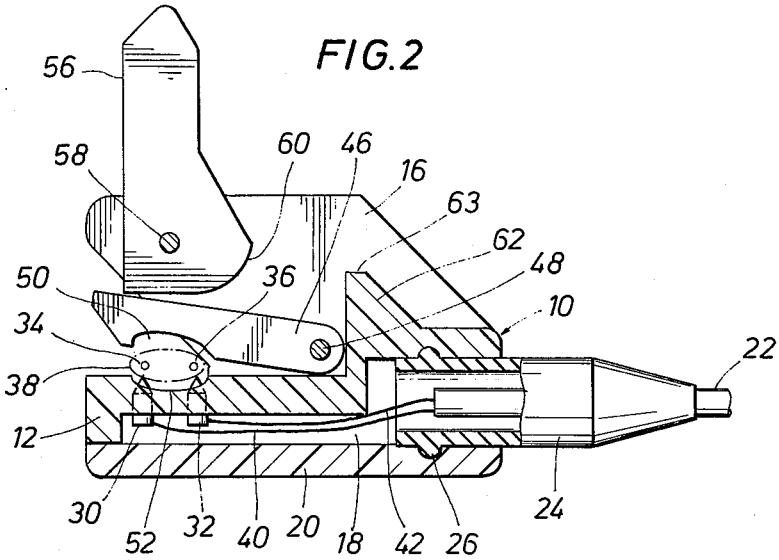
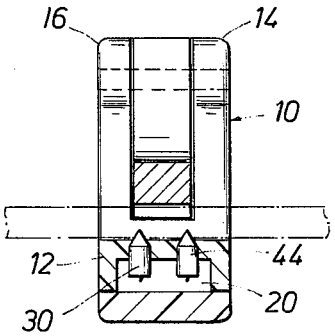
FIG. 4
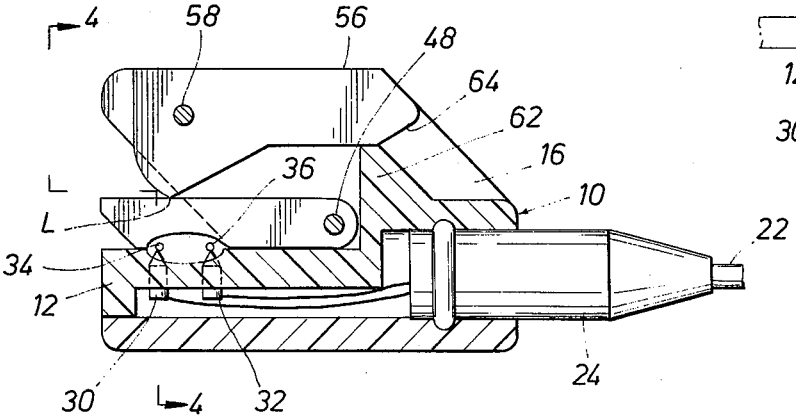
FIG. 3

ELECTRICAL CONNECTOR

This invention relates to electrical connectors.

There are many occasions where it is necessary to make an electrical connection between one or more electrical cables and another somewhere between its ends. For example, in seismic survey operations, a plurality of cables are connected to a common cable at spaced points along its length. After each shot, the cables are disconnected, moved to another location, and reconnected, but not necessarily at the same points along the common cable. Therefore, it is desirable to provide an electrical connector that can connect the conductors in one cable to that of another intermediate its ends quickly and easily and without requiring the stripping of insulation from the common cable, and which will allow the location of the connection to be changed from time to time quickly and easily, and it is an object of this invention to provide such a connector.

It is another object of this invention to provide a connector for connecting one cable to another intermediate its ends without having to strip insulation from the second cable to expose its conductors and that will be locked in position on the second cable when the connection is made, but which can be quickly and easily disconnected from the second cable when desired to do so.

It is another object of this invention to provide an electrical connector that will connect the conductors of one cable to the conductors of a second cable intermediate its ends in such a manner that the connection can be made and then the connector removed and connected at another point along the second cable, and the conductors of the second cable, where the first connection was made, will still be amply protected by the insulation of the cable so that it is not necessary to tape or otherwise protect the conductors of the second cable at the point of the previous connection.

These and other objects, advantages, and features of this invention will be apparent to those skilled in the art from a consideration of this specification, including the attached drawings and appended claims.

In the drawings:

FIG. 1 is an isometric view of the preferred embodiment of the connector of this invention connecting a cable to a second cable intermediate its ends;

FIG. 2 is a sectional view of the connector of FIG. 1 positioned to make the electrical connection of FIG. 1;

FIG. 3 is a sectional view of the connector of FIG. 1; and

FIG. 4 is a view taken along line 4—4 of FIG. 3.

Body 10 of the connector is made of nonconductive material, preferably a plastic that can be molded, and includes base portion 12 and spaced parallel sides 14 and 16. Base 12 has cavity 18 which is covered by plate 20 that is attached to the base and forms a part of the body. The cavity is open at one end to receive the end of cable 22. The cable is connected to the body by connector sleeve 24, which snugly fits the opening in the end of cavity 18. The sleeve is clamped between the base and plate and is held in place by O-ring 26 molded on the outside of connector sleeve 24, which engages a groove provided therefor in base 12 and plate 20 of the body.

In the embodiment shown, the connector is designed to connect a two conductor cable to another two conductor cable. The cables shown are of the type used, for example, as T. V. antenna cables, where the body of insulation enclosing the conductors is generally elliptically shaped, with the two conductors spaced apart along the long axis of the ellipse. In accordance with this invention, electrical contacts are attached to the body and positioned to engage conductors in a cable. Thus, the number and the position of the contacts will be determined by the particular cable to which the connector is designed to be connected. As shown in FIG. 2, in this embodiment, contacts 30 and 32 are positioned to be in alignment with conductors 34 and 36, respectively, of cable 38, respectively. Connector 30 is connected to conductor 40 of cable 22 and contact 32 is connected to conductor 42 of this cable. Since, in this embodiment, the connector is designed to connect a two conductor cable to a two conductor cable, then only two contacts, such as 30 and 32, are required. In order to be doubly sure, however, that the electrical connection is completed, each of conductors 40 and 42 are connected to two contacts. In other words, as shown in FIG. 4, side-by-side with contact 30 and in alignment with conductor 34, is contact 44. Both of these contacts are connected to conductor 40 of cable 22. In a like manner, but not shown in the drawings, another contact is positioned in alignment with contact 32 and conductor 36 of cable 38. This contact 32 is connected to conductor 42 of cable 22.

As shown, the contacts are embedded in body 10, with only a portion of their ends extending from the body. Also as shown, the ends of the contacts are sharpened to a point so that when cable 38 is forced downwardly against the contacts, the point of the contacts will penetrate the insulation and move through the insulation into physical contact with conductors 34 and 36.

To force the contacts into engagement with the conductors, moveable cable clamping member 46 is provided. This member is mounted on the body to extend over the contacts, as shown in FIG. 2. The member is movable away from the contacts to allow the cable to be positioned between the contacts and the member, as shown in FIG. 2, and is movable toward the contacts to clamp the cable between the members and the body, as shown in FIG. 3. In the embodiment shown, cable clamping member 46 is located between parallel sides 14 and 16 of the body. It is mounted on the body for pivotal movement around pin 48, which extends through member 46 and sides 14 and 16 of the body. The surface of the member adjacent cable 38 is provided with groove 50 that is shaped to more or less conform to the outer surface of cable 38. In the same manner, the electrical contacts mounted in the body are positioned so that their outer ends are located in groove 52 which is also designed to conform to the outer shape of the cable and to guide the cable into the proper position for the contacts to engage the conductors of the cable. Sides 14 and 16 are cut away to allow cable 38 to be positioned in groove 52.

Means are provided for forcing the movable clamping member toward the body to clamp a cable therebetween, and to force the contacts through the cable insulation into electrical contact with the cable conductors. In the embodiment shown, cam arm 56 is positioned between sides 14 and 16 of the body and mounted for pivotal movement around pin 58. The cam arm is located above movable clamping member 56 and has cam surface 60 that will move into engagement with the clamping member as the cam arm is moved from the first position shown in FIG. 2 to the second position shown in FIG. 3. As the cam arm moves between the two positions, cam surface 60 will force movable clamping member 46 to pivot around pin 48 toward the body of the connector and force cable 38 downwardly until the contacts have penetrated the insulation of the cable and moved into engagement with the conductors therein, as shown in FIG. 3.

The connector includes means to lock the movable member in clamping position. In the embodiment shown, this means is included in the cam arm by the shape of cam surface 60. Thus, in the embodiment shown, base portion 12 of body 10 includes portion 62 that extends between sides 14 and 16 in the body and provides surface 63 to engage cam arm 56 when it is in its second position shown in FIG. 3. This limits the rotation of the arm in a clockwise direction. When arm 56 is in this position, cam surface 60 engages arm 56 along a line indicated by the letter L, that is positioned so that the line of force between the line of contact of the arm and movable clamping member 46 is on the opposite side of pivot point or shaft 58 from stop member 62. Thus, the clamping force imposed on cam surface 60 by clamping member 46 acts along a line relative to pin 58 that tends to urge cam arm 56 to continue rotating in a clockwise direction and thus holds the arm in engagement with stop surface 63 provided by the body. The connector, then, will stay clamped to cable 38 until cam arm 56 is forcefully rotated in a counterclockwise direction to the position shown in FIG. 2. To facilitate so moving the cam arm, the arm extends beyond the stop portion of the body to allow a finger to be inserted between sides 14 and 16 to engage surface 64 of the arm and force it in a counterclockwise direction to release the connector from the cable.

From the foregoing, it will be seen that this invention is one well adapted to attain all of the ends and object hereinabove set forth, together with other advantages that are obvious and that are inherent to the apparatus.

It will be understood that certain features and subcombinations are of utility and may be employed without reference to other features and subcombinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

The invention having been described, what is claimed is:

1. A cable connector for connecting the conductors of a first electrical cable to the conductors of a second electrical cable at any point along the length of the second cable comprising a body of non-conductive material having a base portion for positioning on one side of the second cable at any point along its length, said base portion having an open ended groove to support the cable without bending the cable, a plurality of electrical contacts attached to the body and located in the groove in position to engage conductors in the second cable, said contacts being connected to the conductors of the first cable and having sharp exposed ends for penetrating the cable insulation covering the conductors of the second cable to engage the conductors, a movable cable clamping member having one end pivotally mounted on the body and the other end extending over the groove in the body and having a groove extending parallel to the groove in the body to combine with the groove in the body to provide a cavity through which the second cable extends when the clamping member is in cable clamping position, said clamping member being movable away from the contacts to allow the second cable to be positioned in the groove in the body between the contacts and the clamping member and toward the groove to clamp the second cable in the grooves of the member and the body without bending the second cable, means for forcing the cable clamping member toward the body to clamp the second cable therebetween and to force the contacts through the cable insulation into electrical contact with the cable conductors, and means for locking the clamping member in said clamping position.

2. The connector of claim 1 in which the means for forcing the clamping member toward the body and for locking the member in said clamping position includes a cam arm pivotally mounted on the body for pivotal movement between a first position where the clamping member can move away from the body to permit the second cable to be positioned between the clamping member and the body and a second position where the clamping member has forced the second cable into the groove in the body until the contacts have penetrated the second cable insulation and engaged the conductors therein, stop means carried by the body to engage the cam arm when it reaches its second position to prevent further movement, said cam arm having a cam surface for engaging the clamping member as the cam arm moves toward its second position to move the clamping member into cable clamping position when the cam arm reaches its second position, said cam surface being in engagement with the clamping member when in said second position for the line of force between the arm and the member to be located relative to the pivotal axis of the cam arm to tend to urge the cam arm toward the stop means to lock the cam arm in its second position holding the clamping member in cable clamping position.

* * * * *